United States Patent [19]

Holowaty et al.

[11] 4,389,249

[45] Jun. 21, 1983

[54] METHOD FOR ADDING INGREDIENT TO STEEL AS SHOT

[75] Inventors: Michael O. Holowaty, Crown Point; Ian F. Hughes, Munster; John Lude, Portage, all of Ind.

[73] Assignee: Inland Steel Company, Chicago, Ill.

[21] Appl. No.: 370,908

[22] Filed: Apr. 22, 1982

[51] Int. Cl.[3] ..... C22C 37/00

[52] U.S. Cl. ..... 75/129

[58] Field of Search ..... 75/129

[56] References Cited

U.S. PATENT DOCUMENTS 3,141,767 7/1964 Funk ..... 75/129

*Primary Examiner*—P. D. Rosenberg

*Attorney, Agent, or Firm*—Merriam, Marshall & Bicknell

[57] ABSTRACT

Alloying ingredients are added as shot to a pouring stream of molten steel flowing from a ladle to a casting mold. The size of the shot is controlled to enhance the recovery and uniformity of distribution in the steel of the alloying ingredients.

11 Claims, 1 Drawing Figure

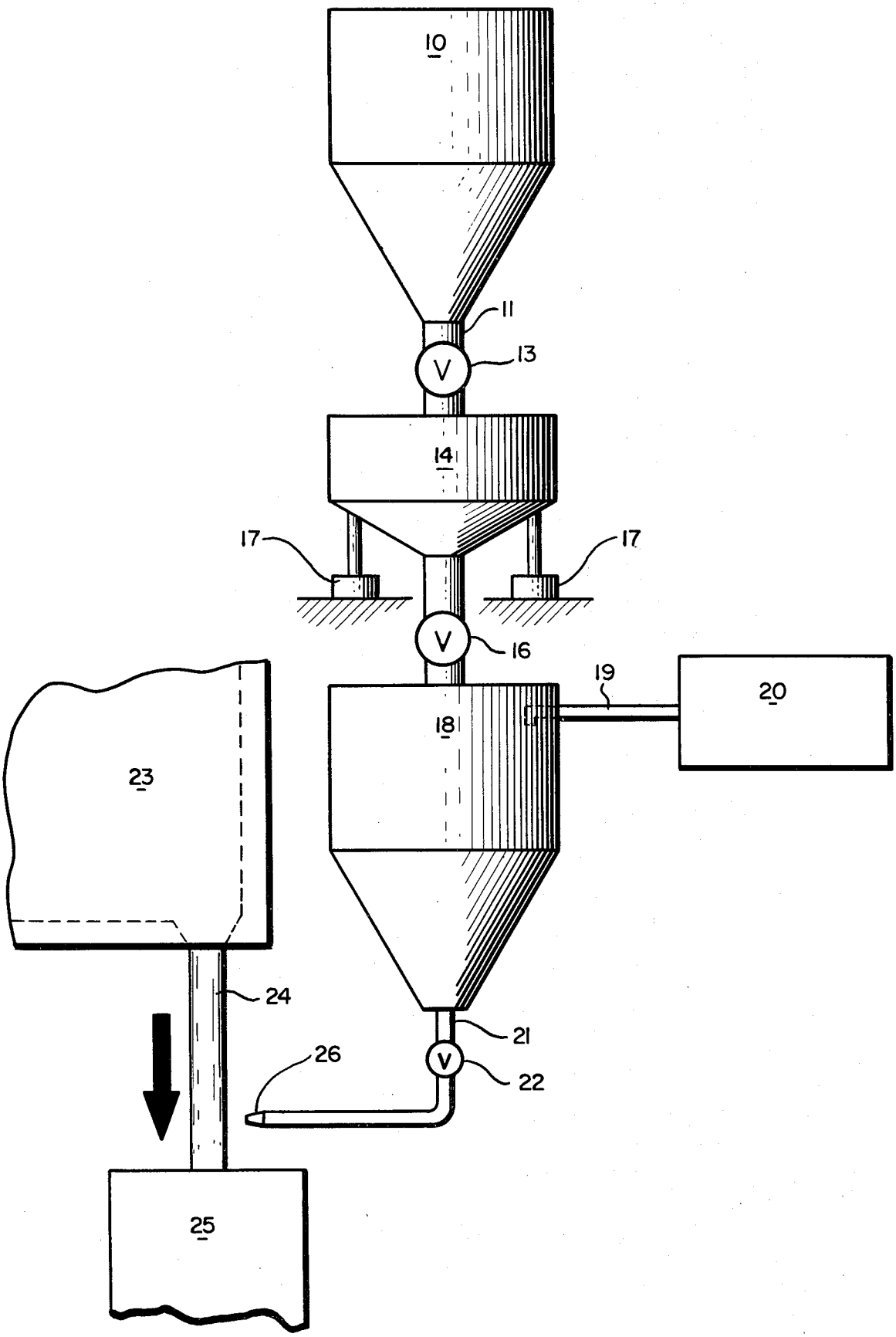
10
11
13
V
14
17
17
V
16
19
20
18
23
24
21
26
V
22
25

METHOD FOR ADDING INGREDIENT TO STEEL AS SHOT

BACKGROUND OF THE INVENTION

The present invention relates generally to methods for adding alloying ingredients to molten steel and more particularly to a method for adding such ingredients in the form of shot.

Examples of alloying ingredients which are added to steel as shot are lead and bismuth. In a typical operation in which lead or bismuth is added to steel as shot, a heat of molten steel is contained in a ladle, and a pouring stream of molten steel is flowed from the ladle to a casting mold, e.g., an ingot mold. Lead or bismuth shot is directed into the pouring stream between the ladle and the casting mold or at the location where the pouring stream impacts in a partially filled casting mold.

The shot may be directed into the molten steel with a shot-adding gun through which the shot is pneumatically conveyed or through which the shot passes in a free flowing fashion, i.e., by gravity. The gun propels the shot so that it can penetrate a pouring stream of molten steel.

Among the prior art which teaches adding bismuth shot to steel, Bhattacharya et al., U.S. Pat. No. 4,255,187 teaches that the bismuth shot should have a size finer than 40 mesh (0.425 mm), and Holowaty et al. U.S. Pat. No. 4,244,737 teaches that the bismuth-containing shot should have a size finer than about 10 mesh (1.98 mm), preferably in the range 20–40 mesh (0.85–0.425 mm) with no greater than 5% minus 100 mesh (0.15 mm).

A commercially available bismuth shot heretofor utilized in conventional operations for adding bismuth to steel had a size range as follows: +18 mesh (1.0 mm), 27.9 wt.%; +20 mesh (0.85 mm), 26.0 wt.%; +40 mesh (0.425 mm), 44.8 wt.%; and −40 mesh, 6.7 wt.%.

Problems arose when bismuth or lead-containing shot of the type described above was added to steel. The recovery of the alloying ingredient contained in the shot was low, and the distribution of the alloying ingredient from one part of the heat to another was relatively non-uniform. In other words, in an operation in which the heat of molten steel was teemed into a multiplicity of ingot molds, there was a substantial variation in the percent of alloying ingredient from one ingot to the next.

It is desirable that the content of the alloying ingredient, such as bismuth or lead, be uniform from one part of the heat to another. Improved recovery is also desirable because the cost of adding an alloying ingredient to the steel decreases as recovery improves.

Oftentimes, the addition of alloying ingredients to the pouring stream generates fumes in the atmosphere adjacent the casting mold, and such fumes (e.g., lead fumes) are undesirable from a health or environmental standpoint. Accordingly, it is conventional to provide apparatus, such as an exhaust hood and associated equipment, for exhausting the atmosphere in the space adjacent the casting mold during the time the pouring stream flows from the ladle into the casting mold. When the alloying ingredient is in the form of shot of the conventional type described above, there is a significant loss of alloying ingredient to the exhaust.

Shot of the conventional type described above has a tendency to agglomerate or cake, particularly in moist or cold weather. This causes malfunctions in the shot-adding gun and non-uniform flow through the gun in turn resulting in non-uniform distribution of alloying ingredient from one part of the heat to another.

SUMMARY OF THE INVENTION

The present invention overcomes the above-described problems which occur when alloying ingredients are added to steel as shot. This is accomplished by controlling the size of the shot within the range 0.5–2.0 mm (0.019–0.078 in.) with no more than about 1 wt.% outside this size range. The present invention is particularly applicable to shot composed of machinability-increasing ingredients selected from the group consisting of bismuth, lead, bismuth-lead alloy, lead-tellurium alloy, bismuth-tellurium alloy, lead-bismuth-tellurium alloy, and combinations of any of the preceding with sulfur.

The present invention is applicable to shot which is added to the molten steel with a gun, and it is applicable to shot which is added to the molten steel without a gun. With respect to the former, the present invention is applicable to both a gun through which the shot is pneumatically conveyed into the molten steel as well as a gun through which the shot passes in a free-flowing fashion. Both types of guns are conventional and are commercially available. When the shot has a size range controlled in accordance with the present invention, shot agglomeration or caking and gun clogging, problems which occur with conventional shot, are substantially reduced.

Controlling the size of the shot, in accordance with the present invention, improves the uniformity of distribution of the alloying ingredient from one part of the heat to another, compared to the distribution resulting from shot not having this size control.

Shot having a size range controlled in accordance with the present invention substantially reduces the amount of alloying ingredient which is lost to the exhaust, compared to shot not having such size control.

Other features and advantages are inherent in the method claimed and disclosed or will become apparent to those skilled in the art from the following detailed description in conjunction with the accompanying diagrammatic drawing.

BRIEF DESCRIPTION OF THE DRAWING

The single FIGURE illustrates schematically an apparatus which may be used in the performance of a method in accordance with an embodiment of the present invention.

DETAILED DESCRIPTION

A ladle 23 contains a heat of molten steel, and a pouring stream 24 flows from ladle 23 into an ingot mold 25. An alloying ingredient in the form of shot having a size controlled in accordance with the present invention is contained in a storage hopper 10 communicating through a conduit 11, having a valve 13, with a weighing hopper 14 supported on load cells 17, 17. Weighing hopper 14 communicates through a conduit 15, having a valve 16, with a closed pressurized hopper 18. Also communicating with pressurized hopper 18 is a conduit 19 leading from a source 20 of compressed gas, such as compressed air. The bottom of pressurized hopper 18 communicates with a conduit 21 having a valve 22 and terminating at a nozzle 26 which directs shot into pouring stream 24.

In operation, valve 13 is initially open and valves 16 and 22 are initially closed. Shot from storage hopper 10 flows into weighing hopper 14 until a predetermined weight is reflected by load cells 17, 17, which is sensed by a control apparatus (not shown) which closes valve 13. Valve 16 is then opened to deliver the predetermined weight of shot into closed pressurized hopper 18. Valve 16 is then closed and compressed gas is introduced through conduit 19 into closed pressurized hopper 18, following which valve 22 is opened, and the shot is pneumatically conveyed through conduit 21 and directed by nozzle 26 into pouring stream 24. In the embodiment described above, the shot is pneumatically conveyed through conduit 21 and propelled to penetrate into the pouring stream. In other embodiments, the shot may pass through the gun into the pouring stream by gravity, i.e., the shot moves in a free-falling fashion. In still other embodiments, a gun for charging the shot into the molten steel may be eliminated entirely.

In the illustrated embodiment, the pouring stream of molten steel is shown as being directed into an ingot mold, but the present invention is equally applicable to a situation in which the pouring stream is directed from a ladle into the tundish of a continuous casting apparatus and to a situation in which a pouring stream flows from the tundish into the continuous casting form or mold. In all such situations, the shot may be directed into the appropriate pouring stream.

Whether the shot is added with or without a gun, and whether the gun is of the pneumatic type or the gravity type, the size of the shot should be controlled in accordance with the present invention, namely, within the range 0.5–2.0 mm (0.019–0.078 in.) with no more than about 1 wt.% outside that size range. Preferably, the size of the shot is controlled within the range 1–2 mm (0.039–0.078 in.) with no more than 0.05wt.% greater than 2 mm and no more than about 1 wt.% less than 1 mm. In another preferable embodiment, the size of the shot is controlled within the range 0.8–1.7 mm (0.0315–0.067 in.) with no more than about 2 wt.% outside that size range. An example of an embodiment of shot having a size range in accordance with the present invention is set forth below in Table I.

TABLE I

| Sieve Size | Wt. % |
|---|---|
| +⅛" (3.175 mm) | Nil |
| +1/16 (1.59 mm) | 27.1 |
| +20 mesh (0.85 mm) | 72.4 |
| −20 mesh | 0.5 |

In its broadest sense, the present invention is applicable to all alloying ingredients added to steel in the form of shot. More particularly, however, the present invention is applicable to machinability-increasing alloying ingredients selected from the group consisting of bismuth, lead, bismuth-lead alloy, lead-tellurium alloy, bismuth-tellurium alloy, lead-bismuth-tellurium alloy, and combinations of any of the preceding with sulfur.

When the shot is composed of two or more machinability-increasing ingredients, the ingredients should be present in ranges as set forth in Table II, wherein the proportions of the various ingredients are expressed in parts.

TABLE II

| | Pb/Bi | Pb/Te | Bi/Te | Pb/Bi/Te |
|---|---|---|---|---|
| Pb | 5–40 | 10–45 | — | 5–40 |

TABLE II-continued

| | Pb/Bi | Pb/Te | Bi/Te | Pb/Bi/Te |
|---|---|---|---|---|
| Bi | 5–40 | — | 10–45 | 5–40 |
| Te | — | 1.5–6 | 1.5–6 | 1.5–6 |

Any of the compositions set forth in Table II may also be combined with up to 25 parts of sulfur.

Specific examples of shot compositions containing two or more machinability-increasing ingredients are set forth in Table III wherein the proportions are expressed in parts.

TABLE III

| | Pb/Bi | Pb/Te | Bi/Te | Pb/Bi/Te |
|---|---|---|---|---|
| Pb | 20 | 28 | — | 15 |
| Bi | 12 | — | 20 | 15 |
| Te | — | 6 | 5 | 4 |

Shot containing machinability ingredients in accordance with the above descriptions may be added to any steels to which have previously been added the machinability-increasing ingredients described above or combinations thereof. A typical composition for such a steel has a base composition (i.e., without machinability-increasing ingredients) in the ranges set forth below, in wt.%:

| | |
|---|---|
| Carbon | 0.06–1.0 |
| Manganese | 0.3–2.0 |
| Sulfur | 0.5 max. |
| Phosphorus | 0.12 max. |
| Silicon | 0.30 max. |
| Iron | essentially the balance |

After the addition to the above-described base steel composition of bismuth or lead, or combinations thereof, all either with or without tellurium, the steel will also contain 0.05–0.45 wt.% bismuth and/or, 0.05–0.45 wt.% lead and perhaps 0.015–0.06 wt.% tellurium.

Comparisons were made with regard to recovery and uniformity of distribution between bismuth shot having a size restriction in accordance with the present invention (Shot A) and bismuth shot of a conventional size distribution (Shot B). The respective size distributions for these two different types of bismuth shot are set forth in Table IV below.

TABLE IV

| Shot A | | Shot B (conventional) | |
|---|---|---|---|
| Sieve Size | Wt. % | Sieve Size | Wt. % |
| +⅛" (3.175 mm) | Nil | +18 mesh (1.0 mm) | 27.9 |
| +1/16" (1.59 mm) | 27.1 | +20 mesh (0.85 mm) | 26.0 |
| +20 mesh (0.85 mm) | 72.4 | +40 mesh (0.425 mm) | 39.4 |
| −20 mesh | 0.5 | "40 mesh | 6.7 |

Each of shot A and shot B was added to molten steel in a manner illustrated in the FIGURE described above. The molten steel to which the bismuth was added had the following base composition, in wt. %

| | |
|---|---|
| Carbon | 0.07–0.09 |
| Manganese | 0.96–1.04 |
| Sulfur | 0.32–0.34 |
| Phosphorus | 0.06–0.08 |
| Silicon | 0.02 max. |

-continued

| | |
|---|---|
| Iron | essentially the balance |

The results obtained with the two different types of bismuth shot are set forth below in Table V. A bismuth content below the aim bismuth content is undesirable, but a bismuth content above the aim is not.

TABLE V

| | Shot A | | Shot B | |
|---|---|---|---|---|
| | Heat #1 | Heat #2 | Heat #3 | Heat #4 |
| Bi input, lb./ton | 7.21 | 7.04 | 7.07 | 6.87 |
| Gross Bi Recovery, % | 63.8 | 62.3 | 62.2 | 50.0 |
| Aim Bi Wt. % | .20–.25 | .20–.25 | .20–.25 | .20–.25 |
| No. of ingots | 21 | 21 | 20 | 20 |
| Highest Bi content wt. % | .27 | .26 | .25 | .21 |
| Lowest Bi content wt. % | .16 | .14 | .13 | .08 |
| No. of ingots having Bi content above aim | 4 | 1 | — | — |
| No. of ingots having Bi content below aim | 1 | 3 | 6 | 18 |
| Range of Bi content, wt. % | .16–.26 | .14–.25 | .13–.25 | .08–.21 |
| Average Bi content, wt. % | .23 | .22 | .22 | .17 |

It is readily apparent from Table V that shot A, in accordance with the present invention, gives a better bismuth recovery and a better uniformity of distribution among the ingots than does the conventional shot B.

Additional heats of bismuth-containing steel were made employing shot A, in accordance with the present invention, and the same base composition as was utilized for the comparisons reflected in Table V, and using the same type of gun to add the shot. The results obtained are set forth in Table VI.

TABLE VI

| Heat No. | 5 | 6 | 7 | 8 |
|---|---|---|---|---|
| Aim Bi. wt. % | .10–.15 | .10–.15 | .20–.25 | .10–.15 |
| No. of ingots | 21 | 20 | 21 | 20 |
| Highest Bi content, wt. % | .14 | .16 | .41 | .15 |
| Lowest Bi content, wt. % | .11 | .11 | .18 | .10 |
| No. of ingots having Bi content above aim | 0 | 3 | 3 | 0 |

TABLE VI-continued

| Heat No. | 5 | 6 | 7 | 8 |
|---|---|---|---|---|
| No. of ingots having Bi content below aim | 0 | 0 | 1 | 0 |
| Rating for uniformity of distribution*, proportion of total ingots 1 | 21/21 | 20/20 | 16/21 | 20/20 |
| 2 | — | — | 5/21 | — |
| 3 | — | — | — | — |
| 4 | — | — | — | — |
| 5 | — | — | — | — |
| Range of Bi content, wt. % | .11–.14 | .11–.16 | .18–.41 | .10–.15 |
| Avge. bismuth content, wt. % | .12 | .13 | .24 | .12 |

*1 = best; 2 = acceptable; 3–5 = inferior.

Table VI shows that in three of the four heats (heats 5, 6, and 8) none of the 61 ingots have a bismuth content below the aim bismuth content, and in the only heat in which there was an ingot having a bismuth content below the aim bismuth content (one ingot out of 21) the bismuth content was only 0.02 wt.% below the minimum aim bismuth content of 0.20 wt.%.

Tables IV, V and VI reflect results obtained with bismuth shot in accordance with the present invention. Similar results would be obtained on similarly sized shot composed of lead or lead and bismuth or any of the foregoing with tellurium. Although particularly relevant to shot composed of machinability-increasing ingredients, the present invention, in a broader sense, is also applicable to any alloying ingredient added to molten steel as shot, especially when the shot is added through a gun.

When employing shot in accordance with the present invention, caking or agglomeration of the shot is not a substantial problem, gun malfunctions are substantially reduced, the flow of the shot through the gun is substantially uniform, distribution through the heat of the alloying ingredient contained in the shot is relatively uniform compared to conventional shot, loss of alloying ingredient to exhausts is substantially reduced, and recovery of alloying ingredient is improved.

The foregoing detailed description has been given for clearness of understanding only, and no unnecessary limitations should be understood therefrom, as modifications will be obvious to those skilled in the art.

We claim:

1. In a process wherein alloying ingredients are added as shot to molten steel which is flowed from a ladle to a casting mold, a method for enhancing the recovery and uniformity of distribution in said steel of said alloying ingredients, said method comprising:

employing a shot size within the range 0.5–2.0 mm, (0.019–0.078 in.) with no more than about 1 wt.% outside said size range;

and feeding said shot into said molten steel without mechanical hurling.

2. In a process as recited in claim 1 wherein:

said shot is composed of alloying ingredients selected from the group consisting of bismuth, lead, bismuth-lead alloy, lead-tellurium alloy, bismuth-tellurium alloy, lead-bismuth-tellurium alloy and combinations of any of the preceding with sulfur.

3. In a process as recited in claim 1 wherein:

the size of said shot is within the range 0.8–1.7 mm. (0.0315–0.067 in.) with no more than about 2 wt.% outside said size range.

4. In a process as recited in claim 3 wherein:

there is no more than about 0.5 wt.% outside said size range.

5. In a process as recited in claim 1 wherein:

said shot is added to a pouring stream of said molten steel flowing from said ladle to said casting mold;

said shot being directed into said pouring stream with a shot-adding gun;

and the employment of said shot size substantially reduces clogging of said gun, compared to shot not having said size.

6. In a process as recited in claim 5 wherein:

said shot is conveyed through said gun and into said pouring stream in a gaseous conveying medium.

7. In a process as recited in claim 1 wherein:

said pouring stream flows from said ladle sequentially into a multiplicity of ingot molds during an ingot teeming operation;

and the employment of said shot size improves the uniformity of distribution of said alloying ingredient among the ingots teemed from said ladle, compared to ingots made with shot not having said size.

8. In a process as recited in claim 1 and comprising:

exhausting the atmosphere in the space adjacent said casting mold during the time said pouring stream flows from said ladle into said casting mold;

the employment of said shot size substantially reducing the amount of alloying ingredient which is lost to the exhaust, compared to shot not having said size.

9. In a process as recited in claim 1 wherein:

the size of said shot is within the range 1–2 mm. (0.039–0.078 in.) with no more than 0.05 wt.% greater than 2 mm. and no more than 1 wt.% less than 1 mm. (0.039 in.).

10. In a process as recited in claim 1 wherein:

said casting mold is an ingot mold.

11. In a process as recited in claim 1 wherein:

said feeding step employs at least one of gravity and pneumatic feeding.

* * * * *

UNITED STATES PATENT AND TRADEMARK OFFICE

CERTIFICATE OF CORRECTION

PATENT NO. : 4,389,249

DATED : June 21, 1983

INVENTOR(S) : Michael O. Holowaty, Ian F. Hughes, and John Lude

It is certified that error appears in the above-identified patent and that said Letters Patent are hereby corrected as shown below:

Column 4, line 57, " "40 mesh "
should be __ -40 mesh __.

Signed and Sealed this

*Thirtieth* Day of *August 1983*

[SEAL]

*Attest:*

GERALD J. MOSSINGHOFF

*Attesting Officer*

*Commissioner of Patents and Trademarks*